United States Patent [19]

Mileti

[11] Patent Number: 4,760,979

[45] Date of Patent: Aug. 2, 1988

[54] CONNECTOR AND BRACE CONNECTION SYSTEM FOR A KITE

[76] Inventor: Robert J. Mileti, 21 Taylor St., Torrington, Conn. 06790

[21] Appl. No.: 29,279

[22] Filed: Mar. 23, 1987

[51] Int. Cl.[4] ..... B64C 31/06

[52] U.S. Cl. ..... 244/153 R; 403/353

[58] Field of Search ..... 244/153 R, 155 R; 135/DIG. 5, DIG. 9, 33 R, 34; 403/361, 353, 242, 263, 305

[56] References Cited

U.S. PATENT DOCUMENTS

| | | | |
|---|---|---|---|
| 3,216,147 | 11/1965 | Miner | 244/153 R |
| 3,542,408 | 11/1970 | Lowrey et al. | 403/353 |
| 4,015,803 | 4/1977 | Temple | 244/153 R |

FOREIGN PATENT DOCUMENTS

| | | | |
|---|---|---|---|
| 1515984 | 6/1978 | United Kingdom | 244/153 R |
| 1517094 | 7/1978 | United Kingdom | 244/153 R |
| 1577585 | 10/1980 | United Kingdom | 244/153 R |

*Primary Examiner*—Galen Barefoot

*Attorney, Agent, or Firm*—St. Onge, Steward Johnston & Reens

[57] ABSTRACT

A device for interconnecting one or more structural braces of a kite and for attaching a means for securing a flying line is provided comprising:

an elongate body having in one end thereof a chamber for receiving an end portion of said structural brace, said chamber having a length and having a cross section sized to secure said brace therein, said body including a notch located intermediate said one end of said body and said chamber length, said notch extending inwardly from one side of said body, said notch having a floor having a depth sufficient to provide an opening between a brace assembled in said chamber and said notch floor, said opening receiving said means for securing said flying line, said notch limiting lateral travel of said securement means inside said notch. A kite assembly is also provided using this interconnecting device.

20 Claims, 4 Drawing Sheets

18
10
24
46
30
50
28
26
44
42
48
16
14
12
34
22
36
38
54
52
32
20

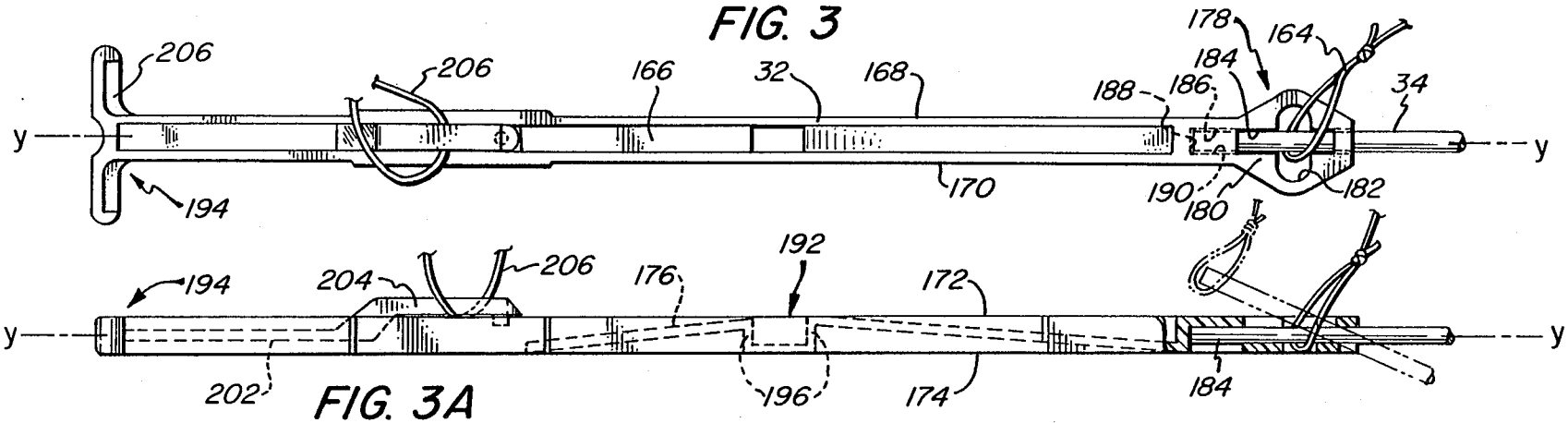
FIG. 3
FIG. 3A
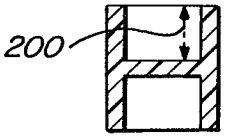
FIG. 3B
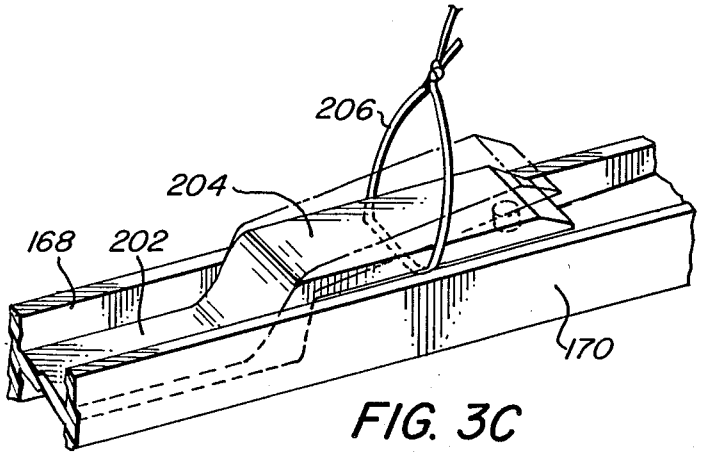
FIG. 3C

CONNECTOR AND BRACE CONNECTION SYSTEM FOR A KITE

BACKGROUND OF THE INVENTION (1) Field of the Invention

This invention relates to a frame system for supporting a kite sail, and more particularly an improved strut for coupling such frame system to said sail to permit ease of assembly, including the convenient anchoring of at least one control or flying line to said frame for controlling said kite in flight. Also shown is a kite assembly using a plurality of said improved struts.

(2) Discussion of the Prior Art

Kites are well known and typically include a sail, a frame for supporting the sail, and control or flying lines for attaching to the frame for controlling the maneuvers of said kite in flight. Additionally, accessories such as a tail may be attached at some point on the frame for changing the aerodynamic characteristics of the kite.

While kites are known in many different forms and designs, a typical kite includes a sail of relatively thin, lightweight material, a frame comprising a cross brace and a vertical brace for supporting the sail, and a bridle or set of control lines attached to the frame by bridle wire clips snapped around corresponding wire rings mounted on the frame. The typical bridle has three clips thereon, one center clip for attaching to the vertical brace and two end clips for attachment to the cross brace, one such clip on either side of the vertical brace. The sail forms openings therein for the bridle lines to extend through the front side of said sail.

The frame is coupled to the sail by means of fitting pockets in the sail and cooperating fittings on the braces. The cross brace has mounted on either end thereof L-shaped fittings that mate with corresponding fitting pockets in laterally opposing side corners of the sail. Likewise, the vertical brace has mounted on either end thereof T-shaped fittings that mate with corresponding fitting pockets in vertically opposing top and bottom corners of the sail. Said fitting pockets are formed along the perimeter of the sail by folding appropriately shaped sections of the border of the sail back on themselves and properly securing said sections to form a flap around the perimeter with the fitting pockets thereby formed at the corners.

The lengths of the cross brace and the vertical brace are chosen so that, when properly inserted between their respective fitting pockets, the braces are in compression and assume a curved contour so that a spring bias is introduced in the braces urging the L-and T-shaped fittings against the fitting pockets in a snug fit. Also, that point where the cross brace passes over the vertical brace is secured by an interlock clip, which restrains said braces in alignment but permits relative slidable motion with respect to each other.

Cross vertical braces are typically formed from relatively small diameter fiberglass rods having circular cross sections, and the L-shaped fittings as well as the T-shaped fittings are formed from any suitable structural plastic material. These fittings are affixed to the ends of said rods during assembly.

The flying lines are attached by a device including several parts which are complicated and time consuming to attach to the bracing rods. More specifically, wire rings are inserted over the rods before the fittings are attached, and said rings are held in position on said rods by tubular bushings securely fastened to the rod.

To attach the control line to a ring, it is necessary to first attach the line to a bridle clip, and then snap or insert the bridle clip into the ring. The flying lines are then attached to each side of the bridle by means of appropriately configured split rings. It would be desirable to provide a less complicated device for securing the flying lines to the kite.

SUMMARY OF THE INVENTION

An interconnecting device is provided for one or more structural braces of a kite comprising an elongate body with a chamber for receiving a brace and a notch located intermediate said chamber, the notch extending inwardly from one side of the body, the notch providing means for securing the flying lines.

Also in accordance with the present invention, such an interconnecting device is provided that can be conveniently molded from a two-piece mold. The elongate body forms three cavities therein aligned with three openings. The walls forming each of the three cavities slope toward their corresponding openings, and the three cavities intersect to form the lengthwise chamber. In one particularly preferred embodiment, the cavities and openings are so dimensioned that a brace being inserted in the chamber can be rotated through an opening corresponding to the notch to receive the flying line loop outside the elongated body before realigning the brace and inserting it completely into the chamber.

Also in accordance with the present invention, a strut is provided for use with a kite assembly, said strut for coupling a cross brace to a fitting pocket in a conveniently removable manner and also for providing an efficient anchoring point for a control line, said strut comprising an elongated member with a lengthwise chamber for receiving a cross brace, said strut having an aperture therein intersecting said chamber, whereby a line loop positioned in said aperture can be rententively engaged by sliding the brace into said chamber, said strut also having a base mating with the fitting pocket. In one embodiment, the base is L-shaped and in another the base is T-shaped.

In a particularly preferred embodiment, the elongated member is of I-shaped cross section along at least a portion thereof, such that the elongated member is relatively flexible in one direction, relatively rigid in another direction, and torsionally rigid about a longitudinal axis of said member. The elongated member may also have an I-shaped cross section that varies in terms of the depth of a cross wall connecting the two parallel side walls of the strut.

Also provided is a kite assembly comprising a sail with fitting pockets and a frame system for supporting said sail, said assembly comprising a cross brace, a pair of L-shaped cross struts of the type of the present invention, a vertical brace, and a T-shaped vertical strut of the type of the present invention.

It is an object of the present invention to provide a strut for a kite assembly that permits efficient connection and disconnection of control lines without clips.

It is a further object of the present invention to provide a strut that can be manufactured in one piece without the need for separate attachment of L-or T-fittings.

It is a further object of the present invention to provide a strut having an I-shaped cross section to increase member stiffness, to resist twisting, and to assist in maintaining the L-and T-shaped fittings in a proper attitude with respect to the fitting pockets and sail, thereby improving wing balance.

It is a further object of the present invention to provide a kite assembly using a plurality of said struts to achieve the advantages set forth above.

Further attendant objectives and advantages will be apparent from the following drawings and detailed description of the preferred embodiments.

BRIEF DESCRIPTION OF THE DRAWINGS

FIGS. 3, 3A, and 3B show top, side, and cross sectional views respectively of the vertical strut of the present invention; and FIG. 3C shows a perspective view of the clip means for attaching a tail.

DETAILED DESCRIPTION 0F THE PREFERRED EMBODIMENTS

Figure 1:
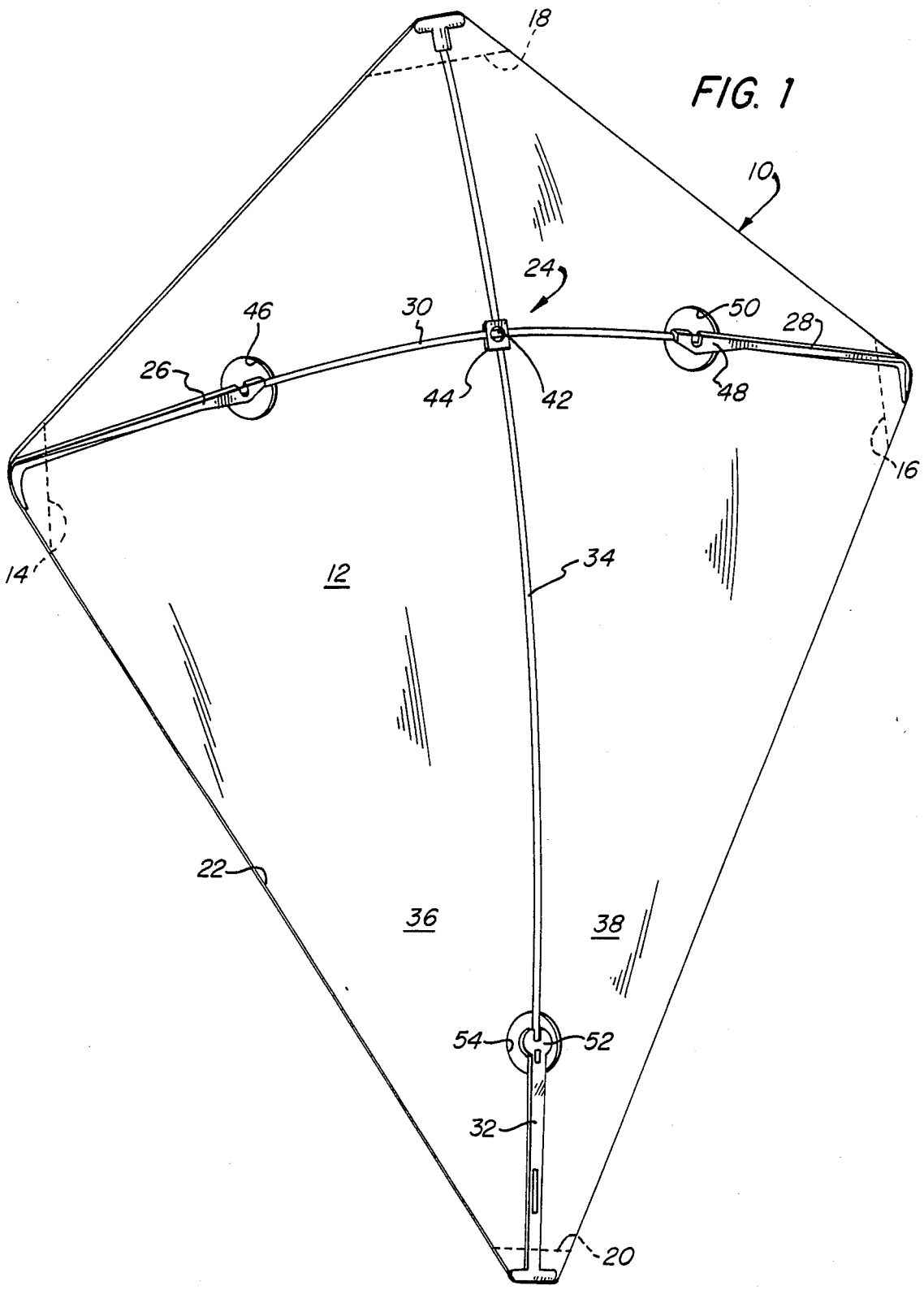
FIG. 1 shows a kite assembly with a frame constructed in accordance with the present invention.

FIG. 1 depicts generally as numeral 10 a kite assembly constructed in accordance with the present invention as seen from the rear where the bracing is exposed. A sail 12 has four fitting pockets 14, 16, 18, and 20 symmetrically placed around the perimeter 22 of sail 12. Fitting pockets 14, 16, 18, and 20 are shown by dotted lines to reveal the details of the bracing underneath.

A frame system indicated generally by the numeral 24 couples with said fitting pockets for supporting sail 12. Fitting pockets 14 and 16 are for receiving the cross framing, or cross struts 26 and 28 in combination with cross brace 30, as described below. Cross brace 30, in combination with cross struts 26 and 28, support sail 12 laterally. Fitting pockets 18 and 20 are for receiving the vertical framing, or vertical strut 32 in combination with vertical spar or brace 34, also as described below. The vertical framing lies substantially along the axis of symmetry of sail 12, thereby dividing sail 12 into two wings 36 and 38, designated here for convenience only as left wing 36 and right wing 38. The vertical framing supports sail 12 in a direction perpendicular to the lateral direction.

As can be seen from FIG. 1, cross strut 26 joins cross brace 30 at a junction point 40 approximately one-half the distance between fitting pocket 14 and that point 42 where cross brace 30 passes over and is joined to vertical spar 34 by interlock clip 44. Interlock clip 44 slidably secures the vertical spar 34 to cross brace 30. While junction point 40 can be varied proportionately, the preferred distance is substantially as that described herein and shown in FIG. 1, so that a control line loop described below can be joined to the frame at juncture point 40 through an opening 46 in sail 12. Likewise, cross strut 28 joins cross brace 30 on the right side at a symmetrically matching point 48, which is aligned with a matching opening 50 in sail 12.

The vertical strut 32 joins vertical brace 34 at a juncture point 52 approximately one-fifth of the distance between the upper and lower fitting pockets 18 and 20. While juncture point 52 can be varied proportilonately, the preferred distance is substantially as that described herein and shown in FIG. 1, so that a control line loop described below can be joined to the frame at juncture point 52 through an opening 54 in sail 12.

Figures 2, 2A, 2B, 2C:
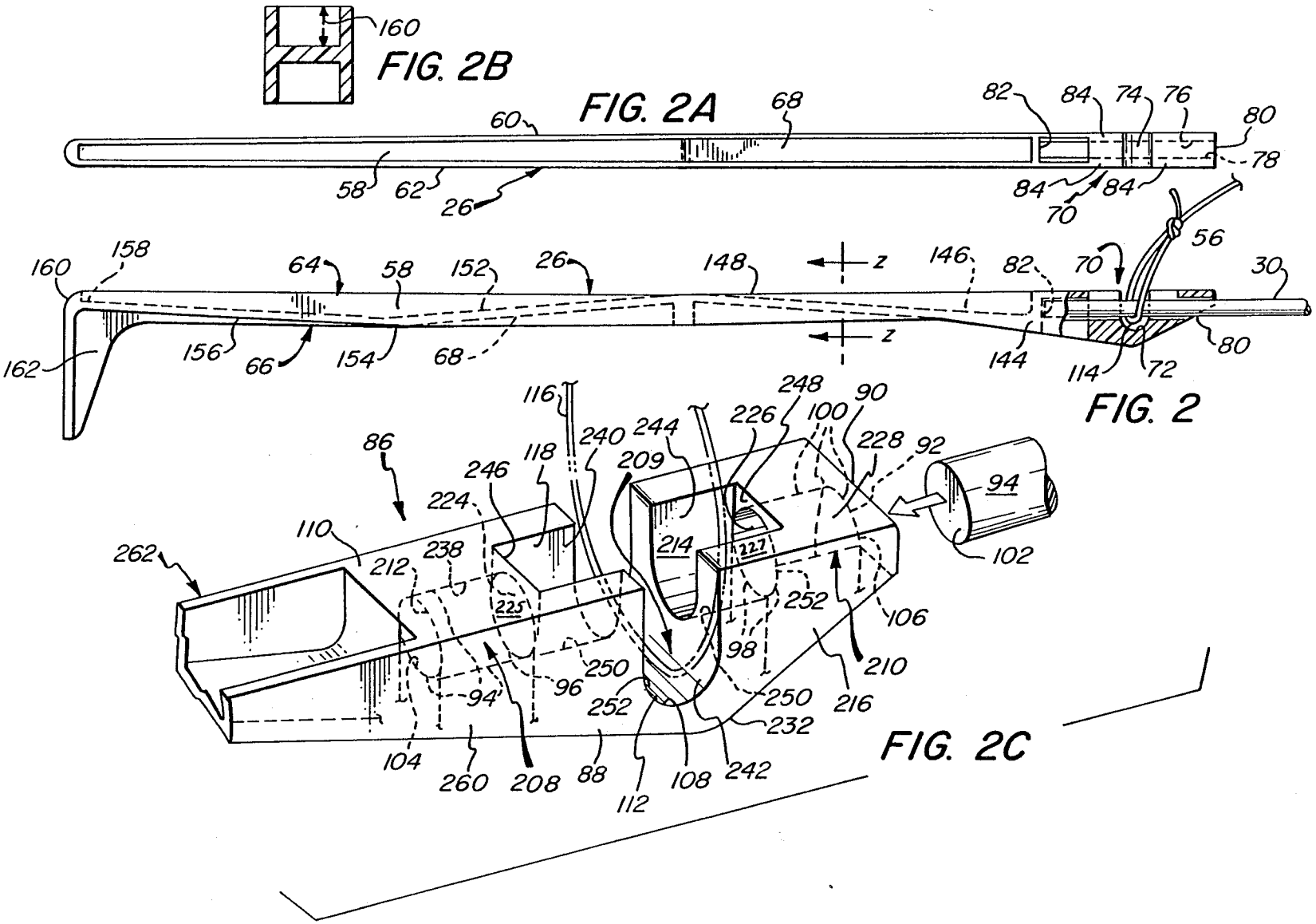
FIGS. 2, 2A, and 2B show side, top view, and cross sectional views respectively of the cross strut of the present invention.
FIG. 2C is a perspective view showing details of the interconnecting device of the present invention.

FIG. 2 shows a side view of the cross strut 26 of FIG. 1 with a portion of the cross brace 30 inserted therein and a control loop 56 anchored around brace 30. FIG. 2A shows a top view of the same cross strut 26, although the cross brace 30 is omitted therefrom. FIG. 2B shows a cross section of strut 26.

As can be seen in FIG. 2, strut 26 comprises an L-shaped elongated member or leg 58, which extends along a longitudinal axis thereof. Leg 58 comprises two distinct parallel opposing side walls 60 and 62 best seen in FIG. 2A, comprised of any suitable structural fiber filled plastic material and having an approximate thickness of preferably 1–2 mm, although other thicknesses may be used as is suitable. The two side walls 60 and 62 are delimited by an upper edge 64 and lower opposing edge 66. Side walls 60 and 62 are joined by a transverse cross wall 68 extending between the two side walls, so that leg 58 has a substantially I-shaped cross section along at least a portion of the longitudinal axis as shown in FIG. 2B. This basic I-beam construction makes leg 58 relatively flexible along the longitudinal axis in a plane parallel to said side walls 60 and 62, but relatively rigid along this longitudinal axis in a plane transverse to said side walls. Additionally, the I-beam cross section makes leg 58 relatively torsionally rigid or resistant to twisting about this longitudinal axis.

Leg 58 forms adjacent end 70 aperture means or notch 72 which is transverse to the longitudinal axis and chamber 74 and extends through leg 58 from side wall 62 through to side wall 60. As seen in FIG. 2, the notch 72 has a partially cylindrical cross-section and is open to side or upper edge 64.

Also formed in end 70 of leg 58 is a lengthwise chamber 74 indicated by the dotted lines 76 and 78 in FIG. 2A. Chamber 74 extends through leg 58 substantially parallel to the longitudinal axis thereof and is open at 80 to receive a mating end of cross brace 30, as indicated in FIG. 2. Chamber 74 has a sufficiently large cross section to removably, slidably receive brace 30, which is under compression when inserted into chamber 74 as part of the assembled kite framing, as explained above and as depicted with respect to FIG. 1. Chamber 74 and therefore inserted brace 30 terminate at point 82 defined by a wall extending across the chamber 74. Because chamber 74 intersects notch 72, as seen in FIGS. 2 and 2A, and because notch 72 is of an appropriately predetermined size with respect to chamber 74, the inserted brace 30 in combination with the notch 72 and the side wall portions 84 adjacent said notch provide means for retentatively engaging or anchoring control line loop 56 on cross brace 30.

This anchoring means provides a quick hook-up point for a control line loop, thereby eliminating the need for rings on the cross brace structure or clips on the control lines. To connect the line, one forms a knotted loop 56 in said line and positions the loop 56 in notch 72, the opening in said loop 56 being loosely aligned with chamber 74. Cross brace 30 is then inserted into chamber 74 and is retained there by compressive forces when two legs (right and left) are used and the cross brace 30 is inserted in both, as shown in FIG. 1. When disassembly is required, the brace 30 is simply pulled out of chamber 74, thereby releasing loop 56.

That portion of leg 58 adjacent end 70 is shown in more detail in FIG. 2C. It is understood that the linterconnecting device of the present invention can be a discrete unit that is simply connected through other routine structural means to the fitting pocket at one end and a cross brace at the other end. Such an embodiment is shown in FIG. 2C, which shows in essence an interconnecting device for one or more structural braces of a kite and for attaching a means for securing a flying line.

As explained in more detail, interconnecting device 86, which can be integrally formed with a leg such as leg 58 or can be a discrete body removably joined to other structural members, comprises an elongate body 88 having in end 90 a chamber 92 for slidably receiving a member 94. Chamber 92 is depicted in FIG. 2C by the plurality of dotted lines 94, 96, 98, and 100. Chamber 92 receives the end 102 of structural brace 94. Chamber 92 has a length defined by the straight line distance from rear wall 104 to the opening 106 at end 90. The chamber 92 also has a cross section substantially defined by rear wall 104, said cross section being sized relative to brace 94 to secure brace 94 when inserted into chamber 92.

Elongate body 88 has a notch 108 located intermediate end 90 and the length of chamber 92. The notch 108 extends inwardly from side 110 of body 88. Notch 108 has a floor 112 having a depth sufficient to provide an opening between brace 94 assembled in chamber 92 and the floor 112. This opening can best be seen as indicated by numeral 114 in FIG. 2, which shows a brace linserted into such a chamber. The opening, such as at 114, receives a loop of flying line 116 or other desired means for securing said flying line. Notch 108 thereby can be seen to limit the lateral travel of the securement means, here a loop of line, inside notch 108.

Figure 2D:
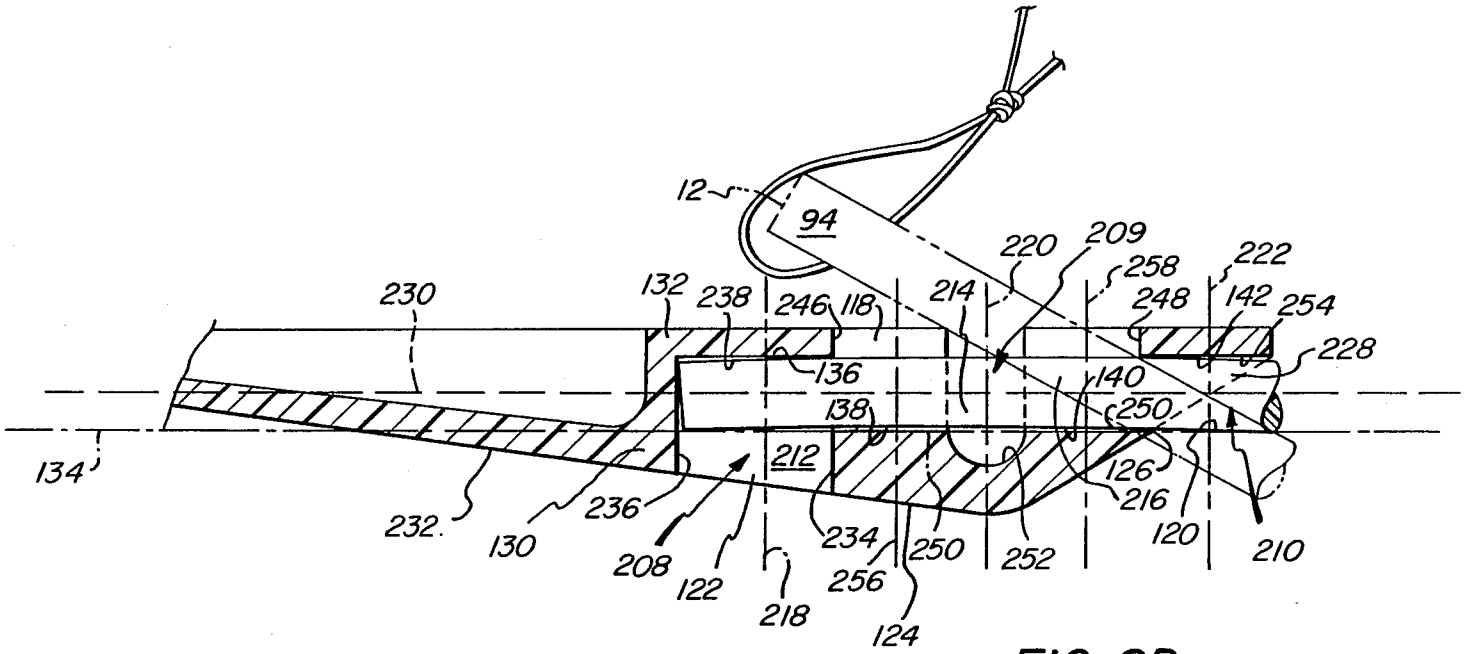
FIG. 2D is a side view with cutaway of the device of FIG. 2D.

As seen from FIGS. 2C and 2D, elongate body 88 forms at least four openings therein in the region proximate end 90. Openings 208, 209, and 210 are aligned with three cavities 212, 214, and 216 that are formed about three axes 218, 220, and 222. Axes 218, 220, and 222 are substantially parallel but noncoincident with respect to each other. Cavities 212 and 214 intersect in region 224 to form a passageway 225 therebetween, while cavities 214 and 216 intersect in region 226 to form a passageway 227 therebetween. Opening 228 in elongate body 88 corresponds to chamber 92. Opening 228 and also chamber 92 are substantially aligned with longitudinal axis 230 of body 88. It can be seen from FIGS. 2C and 2D, as further described in detail below, that the first, second, and third cavities 212, 214, and 216 intersect along longitudinal axis 230 to define chamber 92 along said longitudinal axis 230 open to end 90 of body 88.

The advantage of this construction of interconnecting device 86 is that it permits device 86 to be efficiently molded with a two piece mold. The three cavities 212, 214, and 216 are formed by three mold portions, or teeth, that extend inwardly along axes 218, 220, and 222 respectively. The teeth are aligned to coincide or touch in regions 224 and 226 to form passageways 225 and 227 as described above. After the molded step has been completed, the two piece mold can be separated and the three teeth corresponding to the three cavities 212, 214, and 216 can be withdrawn in a direction generally transverse to longitudinal axis 230, thereby forming chamber 92. The teeth corresponding to cavities 212 and 216 are withdrawn in the lower direction from the lower side of the body 88 as oriented in FIG. 2D, and the tooth corresponding to cavity 214 is withdrawn in the upward direction with respect to the orientation of FIG. 2D.

The further details of the device 88 of FIGS. 2C and 2D are described as follows. Opening 208 ils formed in a first side 232, here the lower side, of body 88. Opening 208 is aligned with cavity 212. Cavity 212 is formed in body 88 by at least one wall 234, the preferred construction being four walls to give the cavity a generally rectangular cross section. Opposing walls 234 and 236 are shown in FIG. 2D; the other two walls are not shown. It is of course understood that cavity 212 need not be formed with four walls, but other configurations known in the art could be used. The cavity 212 is further formed in body 88 with a floor 238, shown in FIG. 2C as curved surface 238 corresponding to a portion of a cylindrical surface. It is understood that floor 238 need not be cylindrical, but could also be another curved or even flat surface sufficient to restrain end portion 102 of brace 94 from moving in a vertical direction as shown in the orientation of FIG. 2D. Walls 234 and 236 are shown in FIG. 2D as being in substantial parallel alignment at all points with axis 218. This alignment is preferable for permitting the molding tooth forming cavity 212 to be drawn out of cavity 212 after the molding step. It is understood that walls 234 and 236 need not be parallel to axis 218. It is also sufficient if the wall or walls defining cavity 212 are such that a tangent to the wall at any point is either in parallel alignment with axis 218, or the angle between the tangent and axis 218 measured toward the opening 208 is equal to or less than 90°. That is, the walls need to slope toward the opening 208 at all points, not away from it at any point, to permit the molding tooth to be withdrawn without damaging the body 88.

Opening 209 is formed in side 110 of body 88. Side 110 is substantially opposite first side 232. It can be seen that, from the perspective of FIGS. 2C and 2D, side 110 corresponds generally to the upper side and side 232 the lower side of body 88. Opening 209 is aligned with cavity 214. It can be seen that cavity 214 can also be described in three portions, or three hollows 240, 242, and 244, which are described in more detail below. Cavity 214 corresponds approximately to notch 108, although the cavity is preferably expanded on either side of notch 108 by said hollows 240 and 244.

Second cavity 214 is formed in body 88 by at least two walls 246 and 248 and a floor 250. Walls 246 and 248 are either in parallel alignment or slope outwardly towards opening 209 at all points to provide for the molding tooth forming same to be effectively withdrawn. Notch 108 also extends through cavity 214 to a point 252 below floor 250, the utility of which is explained above. Wall 246 is aligned with wall 234 to coincide therewith along a portion thereof to leave a void therebetween to form passageway 225 between first and second cavities 212 and 214. Passageway 225 is generally aligned with longitudinal axis 230 to form part of chamber 92.

The three hollows 240, 242, and 244 are all open to the second or upper side 110 of body 88. First hollow 240 is disposed about a fourth axis 256; second hollow is disposed about axis 220, which is the same axis as for the second cavity; and the third hollow is disposed about a fifth axis 258. All axes one through five are substantially parallel to but noncoincident with each other and transverse to the longitudinal axis 230. The walls defining the hollows are either parallel to the axes, or are sloped outwardly towards the second opening 209 to achieve the molding advantages described above. The first hollow intersects the first cavity to form passageway 225 therebetween.

The second hollow 242 corresponds to notch 108. Hollow 242 is therefore open not only to the second or upper side 110 but also the lateral, or third and fourth sides 260 and 262 of body 88. Sides 260 and 262 are substantially opposite each other and substantially transverse to the first and second, or upper and lower sides 110 and 232. Second hollow 242 is disposed about the second axis 220. Hollow 242 intersects hollow 240 to form a passageway therebetween.

The third hollow 244 is open to the second side 110 and is disposed about fifth axis 258. The walls defining hollow 244 are likewise parallel to axis 258 or slope outwardly. The third hollow intersects the second hollow to form a passageway therebetween, and also intersects the third cavity to form passageway 227.

Opening 210 is formed in side 232, or lower side, of body 88, and is in alignment with third cavity 216. Cavity 216 is formed in body 88 by at least one wall 252 and a floor 254. Wall 252 is in substantial parallel alignment with axis 222, or slopes outwardly toward its corresponding opening 210 as described above generally with respect to the other cavities. Wall 252 of the third cavity 216 is aligned with wall 248 of the second cavity 214 to form a passageway 227 therebetween, which passageway 227 is substantially along the longitudinal axis 230 and comprises a part of chamber 92.

The floors 238, 250, and 254 of cavities 212, 214, and 216 respectively cooperate to form three corresponding surfaces for restraining structural brace 94 in chamber 92 from being displaced in the direction defined by the three substantial parallel axes 218, 220, and 222. The passageways 225 and 227 are displaced from perfect alignment along longitudinal axis 230 by a relatively small amount, so that a brace 94 inserted into chamber 92 and through passageways 225 and 227 must be under a bending moment which acts by a wedging action against the three surfaces to removably retain the brace 94 in the chamber 92.

Also, passageway 227, opening 229, and end opening 228 are dimensioned so that the end portion 102 of brace 94 can be inserted through passageway 227 and rotated upwards at an angle upwards of longitudinal axis 230, as shown in FIG. 2D. End portion 102 is extended up through opening 209 to receive flying line loop 116 outside the second cavity 214 and outside the upper side 110 of body 88. Thereafter, the brace 94 is realigned with the longitudinal axis 230 and extended completely into chamber 92 to retain loop 116 inside notch area adjacent surface 252.

A further feature of leg 58 is shown more clearly in FIG. 2, where it can be seen that cross wall 68 is not symmetrically aligned down the center of side walls 60 and 62, but rather varies in position between the two side walls. This variation, while maintaining the basic I-beam cross-sectional configuration as shown in FIG. 2B, imparts certain flexure characteristics to the leg 58 described more fully in detail below.

From FIG. 2, it can be seen that cross wall 68 begins adjacent notched end 70 at a point 144 proximate to lower edge 66 and extends along substantially a straight line 146 to a first nodal area 148 proximate said upper edge 64 at a preselected proportion, preferably approximately one-third, of the distance from notched end 70 to the opposite or shoulder end 150 of leg 58. Also, a structural partition joins side walls 60 and 62 adjacent first nodal area 148 from the upper edge 64 to the lower edge 66, for rigidity.

Cross wall 68 then extends from said first nodal area 148 along a substantially straight line 152 to a second nodal area 154 proximate said lower edge 66 at a predetermined proportion, preferably approximately two-thirds, of the distance from notched end 70 to shoulder end 150. Cross wall 68 then extends from said second nodal area 154 along a substantially straight line 156 to a point 158 adjacent shoulder end 150 and proximate said upper edge 64.

This criss-cross orientation of cross wall 68 gives leg 58 a substantially I-shaped cross section, as seen in FIG. 2B, along the longitudinal axis between notched end 70 and shoulder end 150; however, the perpendicular distance indicated in FIG. 2B as dotted line 160 from cross wall 68 to upper edge 64 varies along the longitudinal axis as described above and as shown in detail in FIG. 2. This criss-cross arrangement imparts desirable flexure characteristics to leg 58.

A further feature of cross strut 26 is shown in FIG. 2. A base, in this case shoulder 162, joins leg 58 adjacent the shoulder end 150 opposite the notched end 70 to form the elongated L-shaped member that is strut 26. Shoulder 162 joins leg 58 at substantially a right angle to the longitudinal axis and extends in a direction opposite to notched side 64. Shoulder 162 further comprises mating means or is shaped to mate in a snug conforming fit with the fitting pocket as shown in FIG. 1.

FIGS. 3, 3A, and 3B show the corresponding vertical strut 32 of FIG. 1 in top, side, and cross-sectional views respectively. The vertical strut 32 is similar in construction and principle to the cross strut 26 of FIGS. 2, 2A, and 2B, with the exception of several salient features described in detail below. FIG. 3 shows a top view of vertical strut 32 with a portion of the vertical brace or spar 34 inserted therein to rententively engage control line loop 164.

As seen in FIG. 3, strut 32 comprises a T-shaped elongated member or rib 166, which extends along a longitudinal axis y—y thereof. Rib 166 comprises side walls 168 and 170. Rib 166 is also delimited by upper and lower edges 172 and 174. Side walls 168 and 170 are joined by cross wall 176 to have the substantially I-shaped cross section shown in FIG. 3B along at least a portion of axis y—y. Rib 166 forms adjacent end 178 a shaped portion 180 forming aperture means 182 extending therethrough, where aperture 182 is transverse to axis y—y and also transverse to cross wall 176. Aperture 182 is open to first and second sides, or upper and lower edges 172 and 174 of rib 166.

Also formed in end 178 is a lengthwise chamber 184 depicted by dotted lines 186, 188, and 190. Chamber 184 extends through rib 166 substantially parallel to axis y—y and is open adjacent end 178 to receive a mating end of vertical brace 34. Chamber 184 and inserted brace 34 terminate at point 188 by a wall extending across chamber 184. Chamber 184 intersects aperture 182 so that control line loop 164 can be rententively engaged by vertical brace 34. This provides a quick connection feature analogous to that described above for strut 26.

Also, cross wall 176 is not symmetrically aligned between side walls 168 and 170. As seen in FIG. 3A, cross wall 176 begins adjacent apertured end 178 proximate lower edge 174 and extends along a substantially straight line to a first nodal area 192 proximate upper edge 172 at a preselected proportion, preferably approximately one-third, of the distance from end 178 to the end 194, or foot end. At first nodal area 192, a dual partition 196 joins the side walls 168 and 170. The cross wall 176 then extends from nodal area 192 along a substantially straight line and terminates proximate to lower edge 174 at point 198 located a predetermined proportion, preferably approximately two-thirds, of the distance from end 178 to end 152. Accordingly, the I-shaped cross section as shown in FIG. 3B varies with respect to the distance indicated by dotted line 200 to obtain desirable flexure characteristics.

Also shown in FIG. 3A, a portion of rib 166 adjacent foot end 194 has a cross-wall portion 202 symmetrically positioned between side walls 168 and 170, and clip means 204 is provided on cross wall portion 202 for grippingly engaging kite accessory means, such as a tail or spinner type tail joined by line loop 206 looped over clip means 204. The use of clip means 204 is shown in FIG. 3C, indicating with in phantom lines how the clip means can be sprung outwardly to receive loop 206. Loop 206 is then retained when clip means 204 returns to its position.

Also provided for strut 32 is a base or foot 206 joining rib 166 at end 194 opposite apertured end 178. Foot 206 joins rib 166 at substantially a right angle to axis y—y and extends outwardly therefrom on both sides. The plane defined by the intersection of foot 206 with rib 166 is normal to the direction of the aperture opening 182. Foot 206 comprises means for mating in a snug conforming fit with the fitting pocket as shown in FIG. 1.

It should be understood that various changes and modifications to the preferred embodiments described above will be apparent to those skilled in the art. Such changes and modifications can be made without departing from the spirit and scope of the present invention, and it is therefore intended that such changes and modifications be covered by the following claims.

I claim:

1. A device for interconnecting one or more structural braces of a kite and for attaching a means for securing a flying line, said structural brace for being under compression when assembled in said kite, the device comprising:

an elongate body having in one end thereof a chamber for receiving an end portion of said structural brace, said chamber having a length defined by an endwall for abutting said end portion of said brace under compression, said chamber further having a cross section sized to secure said brace therein, said body including a notch located intermediate said one end of said body and said chamber length, said notch extending inwardly from one side of said body, said notch having a floor having a depth sufficient to provide an opening between a brace assembled in said chamber and retained therein by said compression and said notch floor, said opening receiving said means for securing said flying line, said notch limiting lateral travel of said securement means inside said notch.

2. The device of claim 1, wherein said chamber provides an opening to said side of said body for a preselected distance on either side of said notch, whereby said end portion can be received part way into said chamber and extended through said opening at an angle to the elongate body for receiving said flying line before said end portion is inserted into the remainder of said chamber.

3. The device of claim 1 wherein said elongate body forms at least first, second, third, and fourth openings therein, three such openings being aligned with three cavities formed by said elongate body, said three cavities being formed about first, second, and third axes respectively, said three axes being substantially parallel and noncoincident with respect to each other and being substantially transverse to said longitudinal axis, the fourth opening corresponding to said chamber and being adjacent said one end of the elongate body and substantially aligned with a longitudinal axis of said body, (a) said first opening being formed in a first side of said body, said first cavity being formed in said body by at least one wall and one floor, said wall being in substantial parallel alignment at all points to said first axis;

(b) said second opening being formed in a second side of said body, said second side being substantially opposite to said first side, said second cavity being formed in said body by at least two walls and one floor, said walls being in substantial parallel alignment at all points to said second axis, one said wall forming said second cavity being aligned with said wall forming said first cavity to coincide therewith along at least a portion of said walls to thereby form a passageway between said first and second cavities, said second cavity also including said notch;

(c) said third opening being formed in said first side of said body, said third cavity being formed in said body by at least one wall and one floor, said wall being in substantial parallel alignment at all points to said third axis, said wall forming said third cavity being aligned with the second said wall forming said second cavity to coincide therewith along at least a portion of said walls to thereby form a passageway between said second and third cavities, said third cavity also being aligned with said fourth opening, whereby said first, second, and third cavities intersect along said longitudinal axis to define said chamber along said longitudinal axis open to said end.

4. The device of claim 3, wherein the floors of the three cavities cooperate to form three surfaces for restraining the structural brace inserted in the chamber from being displaced in the direction as defined by the first, second, and third axes, the passageway between the first and second cavities and the passageway between the second and third cavities being displaced from alignment along the longitudinal axis a relatively small amount, whereby a brace inserted into said chamber and through said passageways must be under a bending moment, thereby being removably retained in the chamber by a wedging action against said three surfaces.

5. The device of claim 4 wherein the passageway between said second and third cavities, the second opening, and the fourth opening are dimensioned to receive said brace through said passageway at an angle to said longitudinal axis, whereby said brace can be extended at an angle through said passageway and up through the second opening for receiving said flying line loop outside said second side before said brace is realigned with said longitudinal axis and extended completely into the chamber to retain said loop inside said notch.

6. The device of claim 3, wherein the wall defining said first cavity is such that a tangent to the wall at any point is either in parallel alignment with said first axis or the angle between said tangent and said first axis measured towards the first opening is equal to or less than 90°; and the wall defining said third cavity being such that a tangent to the wall at any point is either in parallel alignment with said third axis or the angle bwtween said tangent and said third axis measured towards the third opening is equal to or less than 90°, and the second cavity further comprises first, second, and third hollows, (a) a first hollow being open to said second side of said elongated body, said hollow being disposed about a fourth axis, said fourth axis being substantially parallel said first, second, and third axes but non-coinceident therewith, the walls defining said first hollow being such that a tangent to the wall at any point is either in parallel alignment with said fourth axis or the angle between said tangent and said fourth axis measured towards the second opening is equal to or less then 90°, said first hollow intersecting said first cavity to form a passagway therebetween, said passagway lying along a longitudinal axis of said elongate body;

(b) a second hollow corresponding to said notch and being open said second side and also to third and fourth sides of said elongate body, said third and fourth sides being substantially opposite each other and substantially transverse to said first and second sides, said second hollow being disposed about said second axis, the walls defining said second hollow being such that a tangent to the wall at any point is either in parallel alignment with said second axis or the angle between said tangent and said axis measured toward the second opening is equal to or less than 90°, said second hollow intersecting said first hollow to form a passageway therebetween, said passageway lying along said longitudinal axis and being open to said second side;

(c) a third hollow being open to said second side of said elongate body, said third hollow being disposed about a fifth axis, the fifth axis being parallel to said first, second, third, and fourth axes but non-coincident therewith, the walls defining said third hollow being such that a tangent to the wall at any point is either in parallel alignment with said fifth axis or the angle between said tangent and said fifth axis measured towards the second opening is equal to or less than 90°, said third hollow intersecting said second hollow to form a passageway therebetween, said passageway lying alongside said longitudinal axis and being open to said second side said third cavity intersecting said third hollow to form a passageway therebetween, said passageway lying along said longitudinal axis;

whereby said first, second, and third cavities and said first, second, and third hollows intersect along said longitudinal axis to define said chamber along said longitudinal axis open to said end.

7. A strut for use with a kite assembly, said assembly comprising a sail having a fitting pocket along one edge thereof, a brace for providing support for the sail adjacent the fitting pocket, and at least one control line loop for connecting to said brace, said strut for coupling said brace to the fitting pocket in a conveniently removable manner and also for providing an efficient anchoring point for said loop, said strut comprising an elongated member forming a lengthwise chamber therein to a first end of said member for removably, slidably receiving said brace, said member further forming aperture means extending through said member transverse to said chamber and intersecting said chamber, said aperture having a predetermined size whereby the control line loop positioned in said aperture can be rententively engaged by slidingly linserting a mating end of said brace into said chamber and through said loop positioned in said aperture to securely anchor said loop around said brace, said strut further comprising a base joined to an end of said member opposite said first end, said base for mating with said fitting pocket.

8. The strut of claim 7, wherein said aperture is a notch open to a first side of said member, and said base extends away from said member at substantially a right angle thereto in a direction opposite to the notched side to form a substantially L-shaped strut.

9. The strut of claim 8, wherein said aperture extends through said member in a first direction, and said base joins said member and extends outwardly therefrom on both sides of said member at right angles thereto to form a substantially T-shaped strut, said first direction being normal to a plane defined by the intersection of the base with the member.

10. A cross strut for use with a kite assembly, said assembly comprising a sail having at least two fitting pockets on opposing lateral edges of the sail, a cross brace for providing lateral support for the sail between the two fitting pockets, and at least one control line loop for connecting to the brace, said strut for coupling the brace to the fitting pocket in a conveniently removable manner and also for providing an efficient anchoring point for said loop, said strut comprising an L-shaped member having:

(a) a leg extending along a longitudinal axis thereof, said leg comprising two distinct parallel opposing side walls, said side walls being joined by a transverse cross-wall therebetween, whereby said leg has a substantially I-shaped cross section along at least a portion of said axis and is relatively flexible along said axis in a plane parallel to said side walls, is relatively rigid along said axis in a plane transverse to said side walls, and is relatively torsionally rigid about said axis; said leg further forming adjacent one end thereof a notch transverse to said axis extending through both side walls and being open to one side of said leg; said leg further forming in said notched end a lengthwise chamber extending therethrough substantially parallel to said axis, said chamber being open to said notched end and having a sufficiently large cross sectional area for removably slidably receiving said brace under compression, said chamber further extending lengthwise through said leg and terminating at a point beyond said notch, whereby the brace positioned in said chamber and extended to said termination point, in combination with said notch and said side walls adjacent said notch, provide means for anchoring said control line loop on said brace; and (b) a shoulder joining the leg at the end of the leg opposite the notched end at substantially a right angle to said axis, said shoulder comprising means for mating with said fitting pocket.

11. The cross strut of claim 10, wherein said two side walls are delimited by upper and lower opposing edges, said upper edge corresponding with said notched side, and said cross-wall extends between said side walls as follows:

(a) said cross-wall begins adjacent said notched end proximate to said lower edge and extends along a substantially straight line to a first nodal area proximate said upper edge at a preselected proportion of the distance from the notched end to the shoulder end;

(b) said cross-wall then extending therefrom along a substantially straight line to a second nodal area proximate said lower edge at a predetermined proportion of the distance from the notched end to the shoulder end; and (c) said cross-wall then extending therefrom along a substantially straight line to adjacent the shoulder end and proximate said upper edge;

whereby said leg has a substantially I-shaped cross section along said axis between said notched end and said shoulder end and the perpendicular distance from said cross-wall to said upper edge varies along said axis.

12. The cross strut of claim 11, wherein said preselected proportion is approximately one-third and said predetermined proportion is approximately two-thirds, and said strut further comprises a partition joining the side walls from the upper to the lower edge thereof at said first nodal area.

13. A vertical strut for use with a kite assembly, said assembly comprising a sail having an axis of symmetry and a fitting pocket on the bottom edge of the sail, a vertical brace for providing lateral support for the sail along the symmetrical axis thereof, and at least one control line loop for connecting to the brace, said strut for coupling the brace to said fitting pocket in a removable manner and also for providing an anchoring point for said loop, said strut comprising a T-shaped member having:

(a) a rib extending along a longitudinal axis thereof, said rib comprising two distinct parallel opposing side walls, said side walls being joined by a transverse cross-wall therebetween, whereby said rib has a substantially I-shaped cross section along at least a portion of said axis and is relatively flexible along said axis in a plane parallel to said side walls, is relatively rigid along said axis in a plane transverse to said side walls, and is relatively torsionally rigid about said axis; said rib further having at one end a shaped portion forming therein an aperture extending therethrough, said aperture extending in a direction transverse to said axis and substantially transverse to said cross-wall said aperture being open to first and second sides of said rib; said rib further forming in said apertured end a lengthwise chamber extending therethrough substantially parallel to said axis, said chamber being open to said apertured end and having a sufficiently large cross sectional area for removably slidably receiving said brace under compression, said chamber further extending lengthwise through said rib and terminating at a point beyond said aperture, whereby the brace positioned in said chamber and extended to said termination point, in combination with said aperture and said shaped portion adjacent said aperture, provide means for anchoring said control line loop on said brace; and (b) a foot joining the rib at the end of the rib opposite the apertured end at substantially a right angle to said axis, said foot comprising means for mating with said fitting pocket.

14. The strut of claim 13, wherein said two side walls are delimited by upper and lower opposing edges, and said cross-wall extends between said side walls as follows:

(a) said cross-wall begins adjacent said apertured end proximate to said lower edge and extends along a substantially straight line to a first nodal area proximate said upper edge at a preselected proportion of the distance from the apertured end to the foot end; and (b) said cross-wall then extending therefrom along a substantially straight line and terminating proximate to the lower edge at a point located a predetermined proportion of the distance from the apertured end to the foot end;

whereby said rib has an I-shaped cross section along a portion of said axis, and the perpendicular distance from said cross-wall to said upper edge varies along said axis.

15. The vertical strut of claim 14, wherein a portion of the rib adjacent the foot has a cross-wall portion symmetrically positioned between the two side walls, and clip means is provided on said cross-wall portion for grippingly engaging accessory means for said kites.

16. A kite assembly, said kite being controlled by a plurality of control line loops connected thereto, said kite comprising:

(a) a sail having four fitting pockets symmetrically placed around the perimeter thereof;

(b) a frame system for supporting said sail by coupling with said fitting pockets, said frame system comprising:

(i) a cross brace for supporting said sail in a lateral direction;

(ii) a pair of cross struts for connecting said cross brace to a pair of laterally opposing fitting pockets, each said cross strut comprising an elongated member forming a lengthwise chamber therein, said chamber open to a first end thereof for removably slidably receiving a first end of said cross brace, said member further forming a notch adjacent said first end transverse to said chamber and intersecting said chamber, the notch being sufficiently sized so that a control line loop placed in said notch can be rententively engaged by sliding said cross brace through said chamber to securely anchor said loop around said brace, said cross strut further comprising a shoulder joined to the opposite end of said cross strut for mating with said fitting pocket, said cross brace and said cross struts in combination having a predetermined total length when assembled with respect to the distance between said fitting pockets where by said cross brace is retained under compression in the said cross strut chambers when said shoulders are inserted in said fitting pockets;

(iii) a vertical spar for supporting said sail in a direction perpendicular to said lateral direction;

(iv) means for slidably securing the vertical spar to the cross brace; and (v) at least one vertical strut for coupling said vertical spar to a fitting pocket spaced on said perimeter between said laterally opposing fitting pockets, said vertical strut comprising a rib forming a lengthwise chamber therein open to a first end thereof for removably, slidably receiving a first end of said vertical spar, said rib further forming an aperture therein adjacent said first end transverse to said chamber and intersecting said chamber, the aperture being sufficiently sized so that a control line loop placed in said aperture can be rententively engaged by sliding said vertical spar through said chamber to securely anchor said loop around said vertical spar, said vertical strut further comprising a foot joined to the opposite end of said vertical strut for mating with said fitting pocket, said vertical spar and said vertical strut having a predetermined length with respect to the distance between said fitting pocket and a corresponding fitting pocket, whereby said vertical spar is retained under compression in said vertical strut chamber when said foot is inserted in said fitting pocket.

17. A device for interconnecting one or more structural braces of a kite and for attaching a means for securing a flying line, the device comprising:

an elongate body having in one end thereof a chamber for receiving an end portion of said structural brace, said chamber having a length and having a cross section sized to secure said brace therein, said body including a notch located intermediate said one end of said body and said chamber length, said notch extending inwardly from one side of said body, said notch having a floor having a depth sufficient to provide an opening between a brace assembled in said chamber and said notch floor, said opening receiving said means for securing said flying line, said notch limiting lateral travel of said securement means inside said notch, said elongate body further forming at least first, second, third, and fourth openings therein, three such openings being aligned with three cavities formed by said elongate body, said three cavities being formed about first, second, and third axes respectively, said three axes being substantially parallel and noncoincident with respect to each other and being substantially transverse to said longitudinal axis, the fourth opening corresponding to said chamber and being adjacent said one end of the elongate body and substantially aligned with a longitudinal axis of said body, (a) said first opening being formed in a first side of said body, said first cavity being formed in said body by at least one wall and one floor, said wall being in substantial parallel alignment at all points to said first axis;

(b) said second opening being formed in a second side of said body, said second side being substantially opposite to said first side, said second cavity being formed in said body by at least two walls and one floor, said walls being in substantial parallel alignment at all points to said second axis, one said wall forming said second cavity being aligned with said wall forming said first cavity to coincide therewith along at least a portion of said walls to thereby form a passageway between said first and second cavities, said second cavity also including said notch;

(c) said third opening being formed in said first side of said body, said third cavity being formed in said body by at least one wall and one floor, said wall being in substantial parallel alignment at all points to said third axis, said wall forming said third cavity being aligned with the second said wall forming said second cavity to coincide therewith along at least a portion of said walls to thereby form a passageway between said second and third cavities, said third cavity also being aligned with said fourth opening, whereby said first, second, and third cavities intersect along said longitudinal axis to define said chamber along said longitudinal axis open to said end.

18. The device of claim 17, wherein the floors of the three cavities cooperate to form three surfaces for restraining the structural brace inserted in the chamber from being displaced in the direction as defined by the first, second, and third axes, the passageway between the first and second cavities and the passageway between the second and third cavities being displaced from alignment along the longitudinal axis a relatively small amount, whereby a brace inserted into said chamber and through said passageways must be under a bending moment, thereby being removably retained in the chamber by a wedging action against said three surfaces.

19. The device of claim 18, wherein the passageway between said second and third cavities, the second opening, and the fourth opening are dimensioned to receive said brace through said passageway at an angle to said longitudinal axis, whereby said brace can be extended at an angle through said passageway and up through the second opening for receiving said flying line loop outside said second side before said brace is realigned with said longitudinal axis and extended completely into the chamber to retain said loop inside said notch.

20. The device of claim 17, wherein the wall defining said first cavity is such that a tangent to the wall at any point is either in parallel alignment with said first axis or the angle between said tangent and said first axis measured towards the first opening is equal to or less than 90°; and the wall defining said third cavity being such that a tangent to the wall at any point is either in parallel alignment with said third axis or the angle between said tangent and said third axis measured towards the third opening is equal to or less than 90°, and the second cavity further comprises first, second, and third hollows, (a) a first hollow being open to said second side of said elongate body, said hollow being disposed about a fourth axis, said fourth axis being substantially parallel to said first, second, and third axes but non-coincident therewith, the walls defining said first hollow being such that a tangent to the wall at any point is either in parallel alignment with said fourth axis or the angle between said tangent and said fourth axis measured towards the second opening is equal to or less than 90°, said first hollow intersecting said first cavity to form a passageway therebetween, said passageway lying along a longitudinal axis of said elongate body;

(b) a second hollow corresponding to said notch and being open to said second side and also to third and fourth sides of said elongate body, said third and fourth sides being substantially opposite each other and substantially transverse to said first and second sides, said second hollow being disposed about said second axis, the walls defining said second hollow being such that a tangent to the wall at any point is either in parallel alignment with said second axis or the angle between said tangent and said axis measured toward the second opening is equal to or less than 90°, said second hollow intersecting said first hollow to form a passageway therebetween, said passageway lying along said longitudinal axis and being open to said second side;

(c) a third hollow being open to said second side of said elongate body, said third hollow being disposed about a fifth axis, the fifth axis being parallel to said first, second, third, and fourth axes but non-coincident therewith, the walls defining said third hollow being such that a tangent to the wall at any point is either in parallel alignment with said fifth axis or the angle between said tangent and said fifth axis measured towards the second opening is equal to or less than 90°, said third hollow intersecting said second hollow to form a passageway therebetween, said passageway lying alongside said longitudinal axis and being open to said second side, said third cavity intersecting said third hollow to form a passageway therebetween, said passageway lying along said longitudinal axis;

whereby said first, second, and third cavities and said first, second, and third hollows intersect along said longitudinal axis to define said chamber along said longitudinal axis open to said end.

* * * * *